United States Patent [19]

Henriques

[11] 4,313,721

[45] Feb. 2, 1982

[54] OIL BURNER DIFFUSER

[76] Inventor: Joseph Henriques, 32 Hidden Brook Dr., Brookfield, Conn. 06804

[21] Appl. No.: 20,932

[22] Filed: Mar. 15, 1979

[51] Int. Cl.[3] ..... F23Q 3/00

[52] U.S. Cl. ..... 431/265; 431/351; 239/424.5

[58] Field of Search ..... 431/10, 265, 351, 352; 239/424.5

[56] References Cited

U.S. PATENT DOCUMENTS

| | | | |
|---|---|---|---|
| Re. 30,160 | 11/1979 | Emory et al. | 60/748 |
| D. 251,851 | 5/1979 | Palm et al. | D23/126 |
| D. 253,245 | 10/1979 | Allenbaugh | D23/36 |
| 1,953,483 | 4/1934 | Higinbotham | 431/265 |
| 2,090,566 | 8/1937 | Andler | 239/406 |
| 2,090,567 | 8/1937 | Andler | 239/406 |
| 2,109,027 | 2/1938 | McCullough | 239/406 |
| 2,502,664 | 4/1950 | Nest | 431/265 |
| 2,665,748 | 1/1954 | Cornelius | 431/265 |
| 2,790,490 | 4/1957 | Smith | 239/406 |
| 3,003,548 | 10/1961 | Sanders et al. | 239/424 |
| 3,211,207 | 10/1965 | Luff | 239/406 |
| 3,360,929 | 1/1968 | Drewry | 431/351 |
| 3,404,844 | 10/1968 | Walsh | 239/406 |
| 3,406,002 | 10/1968 | Martin | 431/265 |
| 3,409,231 | 11/1968 | Oehlerking | 239/406 |
| 3,490,858 | 1/1970 | Fletcher | 431/265 |
| 3,493,180 | 2/1970 | Walsh | 239/406 |
| 3,529,917 | 7/1970 | Hindenlong | 431/351 |
| 3,574,508 | 4/1971 | Rothhaar et al. | 431/351 |
| 3,632,286 | 1/1972 | Kegan et al. | 431/284 |
| 3,694,135 | 9/1972 | Dancy et al. | 431/265 |
| 3,733,169 | 5/1973 | Lefebvre | 431/265 |
| 3,869,243 | 3/1975 | Creuz | 431/90 |
| 3,881,863 | 5/1975 | Creuz | 432/222 |
| 3,923,251 | 12/1975 | Flournoy | 239/402.5 |
| 4,012,189 | 3/1977 | Vogt et al. | 431/353 |
| 4,014,639 | 3/1977 | Froehlich | 431/353 |
| 4,096,996 | 6/1978 | Ketchum | 431/352 |
| 4,157,241 | 6/1979 | Samuelson | 431/349 |
| 4,162,888 | 7/1979 | Weishaupt et al. | 431/183 |
| 4,171,199 | 10/1979 | Henriques | 431/351 |
| 4,171,946 | 10/1979 | Vollerin | 431/353 |

FOREIGN PATENT DOCUMENTS

| | | | |
|---|---|---|---|
| 386159 | 12/1923 | Fed. Rep. of Germany | 239/424.5 |
| 569642 | 2/1933 | Fed. Rep. of Germany . | |
| 2113404 | 9/1972 | Fed. Rep. of Germany . | |
| 2715456 | 10/1978 | Fed. Rep. of Germany | 431/265 |

*Primary Examiner*—Carroll B. Dority, Jr.
*Attorney, Agent, or Firm*—Mattern, Ware, Stoltz & Fressola

[57] ABSTRACT

The present invention relates to oil burner combustion efficiency improving devices, known as diffusers, and particularly to such devices used in conjunction with gun-type pressurized oil burners. The present invention comprises a forwardly positioned cone having a central opening and a series of holes peripherally spaced around the central opening, a cylindrical member extending rearwardly from the periphery of the cone, and a back ring having a large central opening radially extending inwardly toward the central opening of the cone. The diffuser achieves nearly complete combustion of the emanating fuel oil from the spary nozzle with a minimum of excess air and with virtually no carbon deposit buildup on it or the oil burner components.

24 Claims, 12 Drawing Figures

FIG. 3
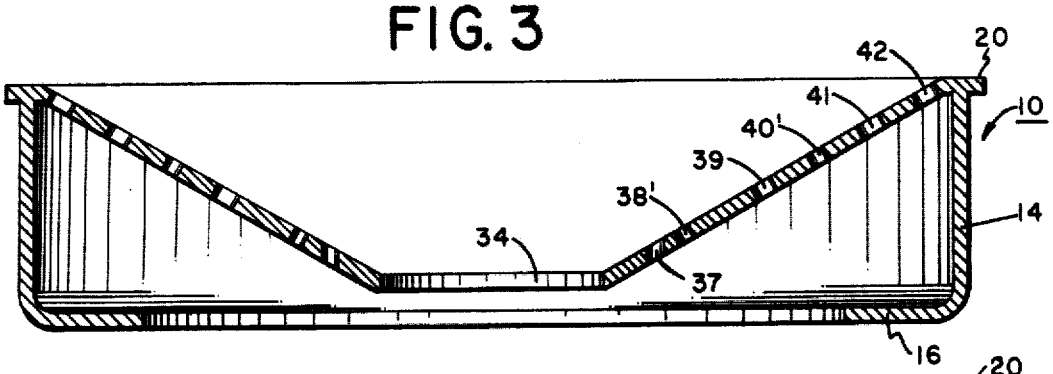
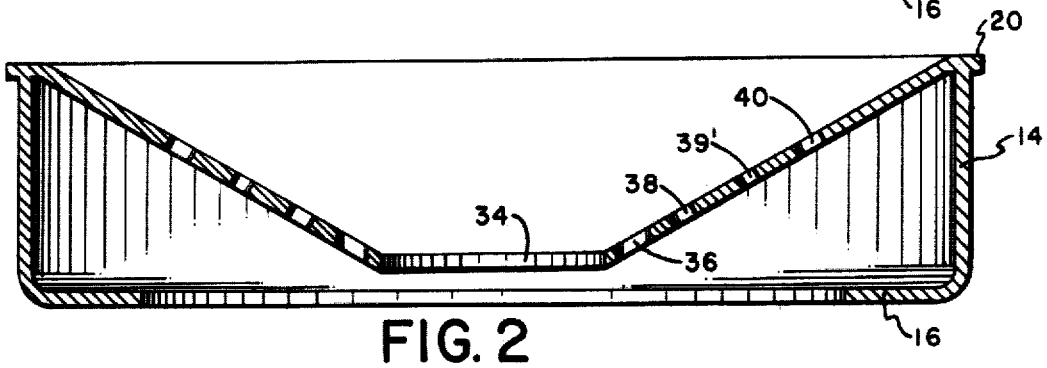
FIG. 2
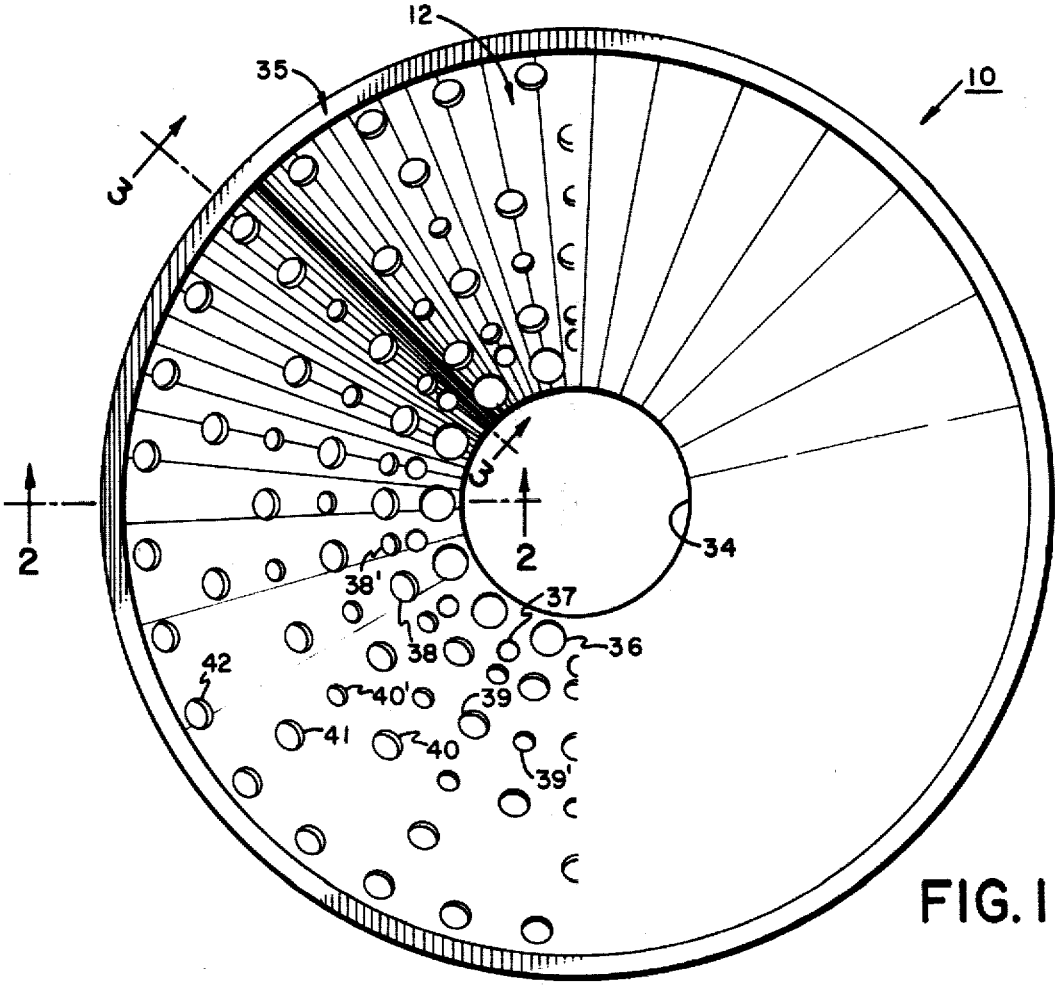
FIG. 1

FIG. 8
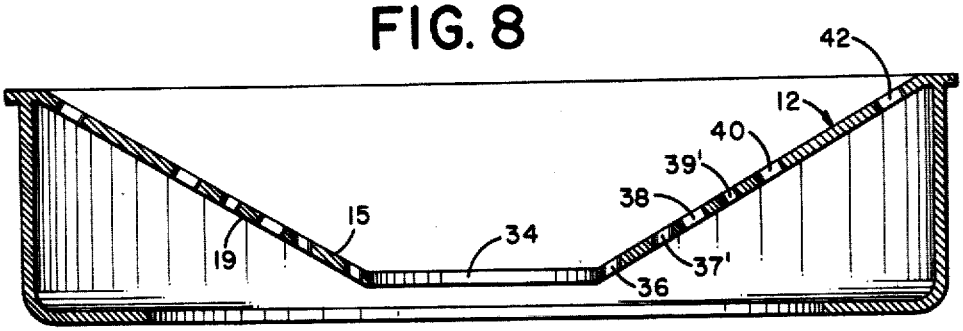
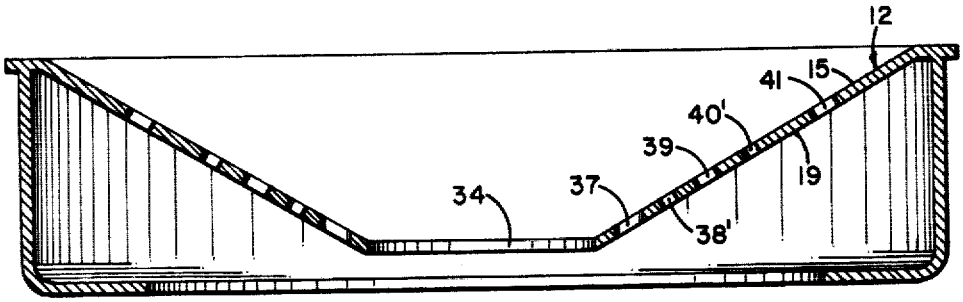
FIG. 7
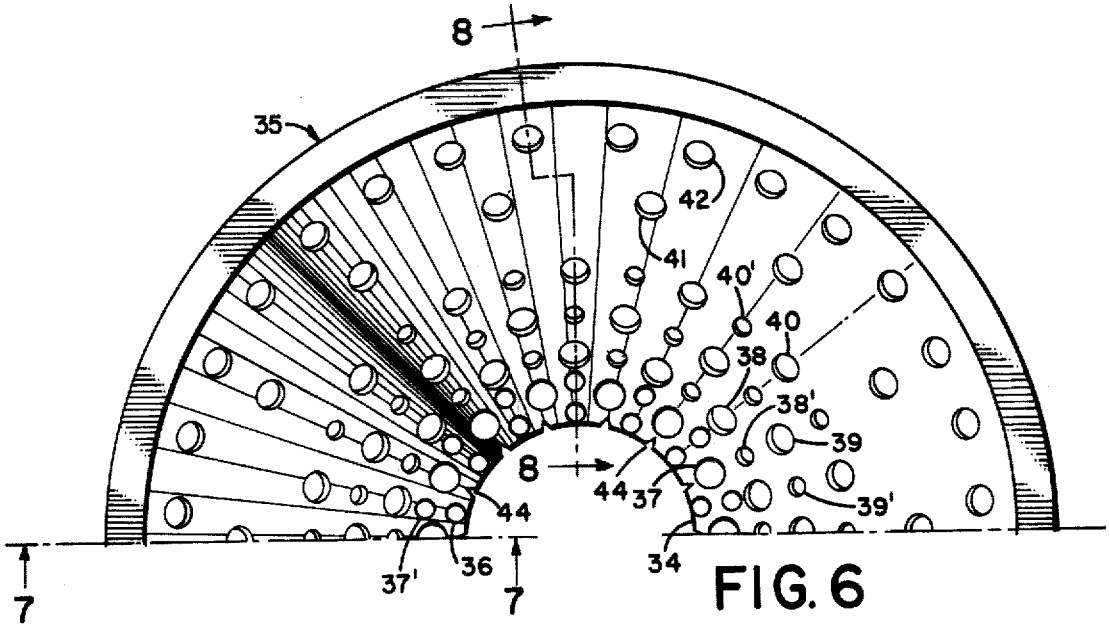
FIG. 6

Diffuser Shown in FIGURES 6–8

OIL BURNER DIFFUSER

CROSS REFERENCE TO RELATED PATENTS

The present application incorporates by reference the subject matter of U.S. Pat. No. 4,171,199, issued Oct. 16, 1979, to the same inventor as stated herein.

BACKGROUND ART

The purpose of the present invention is to increase the combustion efficiency of an oil burner, especially those of the gun-type employing a liquid fuel atomizing nozzle discharging a hollow or solid conical fuel spray. Such oil burners are commonly used in home furnaces and boilers as well as in many commercial furnaces and boilers. In such conventional oil burners, the air is introduced through a blast tube in the vicinity of the oil emanating from the nozzle so as to intermingle with the oil. The mixture is ignited typically by a pair of high voltage electrodes.

In order to obtain nearly complete combustion of the emanating oil it has been necessary to use more than the amount of air which would theoretically be necessary to oxidize (burn) the fuel oil. As is well known in the art, the No. 2 fuel oil commonly used in such oil burners consists primarily of molecular combinations of carbon and hydrogen. Each of these elemental components burn independently and separately combine with a part of the oxygen present in the emanating air. According to a publication entitled "Technician's Manual", Education Publication ED 70 211, page F.O.D.B.-20, the hydrogen component of the oil, being a highly combustible gas, oxidizes faster and requires a smaller amount of air as compared to the carbon component of the oil in order to oxidize. The hydrogen oxidizes in the ratio of two parts of hydrogen to one part of oxygen to form water vapor. If there was no more air available, the remaining carbon in the fuel oil would be thrown off to become a carbon deposit, commonly called soot. However, if additional air is admitted through the blast tube, one part carbon will combine with one part oxygen to yield carbon monoxide (CO), which is also a combustible gas. If more air is available, there will likewise be more oxygen available so that one part carbon will combine with two parts of oxygen to form carbon dioxide ($CO_2$), which is a non-combustible gas representing complete combustion of the fuel oil.

The No. 2 fuel oil commonly used in home furnaces and boilers contains approximately 140,000 British thermal units (BTU's) per gallon (9,340,000 calories per liter). If complete combustion of the oil were obtained with no excess oxygen, the products of combustion would be water vapor (oxidation of the hydrogen), carbon dioxide (oxidation of the carbon), and nitrogen (the primary remaining constituent of air which does not take part in the combustion of the fuel oil). For the No. 2 fuel oil utilized in conventional oil burners, the highest theoretical percentage of carbon dioxide in these products of combustion is 15.6%. This represents a chemical reaction where all the hydrogen and carbon in the fuel oil is completely oxidized with no excess air. Such a chemical reaction is called a stoichiometric reaction. In most conventional oil burners, a percentage of between 10 and 12% carbon dioxide in the combustion products is the highest obtainable percentage due to the necessity of utilizing excess oxygen and therefore excess air to obtain complete combustion of fuel oil. The percentage of excess air as a function of the carbon dioxide percentage is given below (values obtained from above mentioned "Technician's Manual", page O.B.T.C.T.-48):

| % $CO_2$ | % Excess Air |
|---|---|
| 15.5 | 0 |
| 14 | 7 |
| 12 | 25 |
| 10 | 50 |
| 8 | 81 |
| 6 | 142 |
| 4 | 218 |

The present invention through experimental testing has been able to obtain better than 15% carbon dioxide in the combustion products (less than 7% excess air), while maintaining nearly complete combustion of the oil with no carbon buildup (soot) on the diffuser or parts of the conventional oil burner. This represents a reduction of excess air or more than 18 to 43 percent as compared to conventional oil burners.

Thus, in general, a device for improving the combustion efficiency of an oil burner must attempt to minimize the amount of excess air needed for as complete as possible combustion of the fuel oil. It must also minimize the buildup of smoke within the combustion chamber and carbon deposits on the combustion improving device and other parts of the oil burner. Otherwise the carbon buildup can impair or even stop the operation of the oil burner (especially the oil nozzle and igniting electrodes) and can dramatically reduce the heat conducting transfer efficiency of the oil burner heat exchanger.

In actual operation, the amount of smoke present in the combustion product is measured by the Bacharach True Spot Smoke Tester, a device which is well-known in the oil heating art. The combustion efficiency is usually measured by measuring the amount of carbon dioxide in the exhaust gases since carbon dioxide is the easiest product of combustion to quantitatively measure. Its measurement is usually made with a fyrite carbon dioxide analyzer, another device well-known in the oil heating art.

Although a number of prior art devices have been disclosed which attempt to increase combustion efficiency, none of these devices disclose or suggest an oil burner combustion efficiency improving device mounted at the end of a gun-type burner blast tube having a forwardly or downstream positioned cone with an upstream central opening, a plurality of holes circularly spaced about the central opening in a configuration which, when taken in conjunction with a rearwardly extending cylindrical member mounted to the outer periphery of the cone and a back ring radially extending inwardly from the rearward termination of the cylindrical member, provides for nearly complete combustion of the fuel oil with a minimum of excess air and wihout carbon buildup on the diffuser itself or on components of the gun-type burner. Although all of the reasons why the present invention is able to achieve nearly complete combustion of the fuel oil with minimum excess air and without carbon buildup are not completely understood, it is believed that the attributes of the present invention are at least in part due to obtaining a rotationally static air flow pattern emanating from the diffuser cone such that the intermixing of the air with the fuel oil approaches an ideal state. The air flow pattern also prevents the oil droplets, which typically exit from the oil nozzle in a hollow cone pattern, from at least contacting the inner half of the cone front surface. Although it has not been empirically established, it may also be that the present diffuser actually prevents oil droplet deposition throughout the cone front surface. In any event, the outer portion of the cone where oil may come in contact is sufficiently hot to self clean any carbon deposits. Thus, no carbon buildup is obtained and therefore fouling of the diffuser and oil burner parts is prevented.

The following prior art references are believed to be relevant with respect to the present invention:

| U.S. Pat. No. | Inventor | Date of Issue |
|---|---|---|
| 1,953,483 | Higinbotham | 1934 |
| 2,090,566 | Andler | 1937 |
| 2,090,567 | Andler | 1937 |
| 2,109,027 | McCullough | 1938 |
| 2,502,664 | Nest | 1950 |
| 2,665,748 | Cornelius | 1954 |
| 2,790,490 | Smith | 1957 |
| 3,003,548 | Sanders et al | 1961 |
| 3,211,207 | Luft | 1965 |
| 3,360,929 | Drewry | 1968 |
| 3,404,844 | Walsh | 1968 |
| 3,406,002 | Martin | 1968 |
| 3,409,231 | Oehlerking | 1968 |
| 3,490,858 | Fletcher | 1970 |
| 3,493,180 | Walsh | 1970 |
| 3,529,917 | Hindenlang | 1970 |
| 3,574,508 | Rothhaar | 1971 |
| 3,632,286 | Kegan et al | 1972 |
| 3,694,135 | Dancy et al | 1972 |
| 3,733,169 | Lefebvre | 1973 |
| 3,869,242 | Creuz | 1975 |
| 3,881,863 | Creuz | 1975 |
| 3,923,251 | Flournoy | 1975 |
| 4,012,189 | Vogt et al | 1977 |
| West German Patent 386,159 | | 1923 |

Copies of these references will be made part of the patent application file.

More particularly, U.S. Pat. No. 1,953,483, Higinbotham, discloses an oil burner having a head with a curved passage for discharge of air in a whirling motion and a deflector to direct air across the face of an oil burner nozzle, the head having an orifice for the passage therethrough to air to provide an air cushion for the head and the whirling air providing a counter current which, together with the air cushion, impinges upon the oil spray. The air pattern arrangement of this oil burner is highly different than that obtained by the present invention. It also does not disclose or suggest the hole pattern and diffuser cone shape for obtaining the air pattern of the present invention.

U.S. Pat. Nos. 2,090,566 and 2,090,567, Andler, both basically disclose the same invention, including a deflection disc 6 for generating an air flow in the shape of an annulus having a gyrating motion when it is discharged through a space generated by an inwardly tapering wall 9 and a truncated cone 10 with the result that it is formed into a vortex. It is disclosed that the oil is sprayed from an end 11 of the blast tube into this gyrating lamina of air so that it is mixed for combustion. Neither of these references disclose the shape, hole pattern, and resulting air pattern obtained by the present invention.

U.S. Pat. No. 2,109,027, McCullough, discloses a mixing well or ball adjacent the nozzle of an oil burner for mixing the air before it passes over the nozzle in order to obtain more thorough mixing and more efficient burning. The end of the nozzle has an inner surface 9 directing air inward toward the center of the tube to a theoretical point 10. Such an air flow direction is highly different from the rotationally static air flow obtained by the present invention. This reference also does not disclose the hole pattern, cone shape and back ring arrangement as disclosed in the present invention.

Likewise, the multiplicity of slit openings disclosed in U.S. Pat. No. 2,502,664, Nest, preferably spaced in the form of louvers 12 so as to separate the main air stream into a multiplicity of overlapping streams of air issuing into a form that resembles ribbons to produce a stable vortex at the point of flame propogation is again different than the rotationally static shaped fuel/air mixing obtained by the present oil diffuser.

Although U.S. Pat. No. 2,665,748, Cornelius, discloses air passages 49 and 51, the arrangement of these air passages is unlike the hole pattern of the present invention. The Cornelius reference discloses the generation of a rotary stream of air about the burning stream of sprayed liquid fuel while the fuel is being converted into a gaseous form so as to reduce noise and to prevent deposition of carbon on the inner surface of combustion head 22. Although the present invention obtains carbon free combustion, it is believed to be in part due to the air stream pattern and also due to the elevated operating temperature of the diffuser rather than a rotary air pattern as disclosed by Cornelius.

U.S. Pat. Nos. 2,790,490, Smith; 3,003,548, Sanders et al, 3,211,207, Luft; 3,404,844, Walsh; 3,406,002, Martin; 3,409,231, Oehlerking; 3,390,858, Fletcher; and 3,493,180, Walsh, all disclose various oil burners and oil burner attachments which also generate either a whirling air motion by use of vanes and the like or a diverging air flow pattern by use of hollow cones such as that disclosed in Sanders et al. None of these references disclose or suggest the use of an oil burner diffuser having a cone shape and an air hole pattern as well as a back ring for effecting a rotationally static air flow pattern in the vicinity of the emanating oil spary. Likewse, U.S. Pat. No. 3,574,508, Rothhaar et al, although disclosing a burner assembly having a cone 34 incorporating a plurality of holes with the fuel nozzle 50 positioned at the narrowmost end of the cone, its resulting air pattern obtained as the air is forced over the outer portion of the cone is of a swirling motion so as to mix with the gas fuel emanating from the nozzle 50. Disclosure of such a hole pattern is unlike that of the present invention and clearly obtains an air flow pattern unlike that of the present invention.

This result is similarly true with respect to German Pat. No. 386,159 which discloses a dam nozzle-ring 4 placed in front of an air-nozzle 6, the nozzle-ring having nozzles $4^a$ or $4^b$ as shown in FIG. 2 thereof. These nozzles or vanes have a smaller cross-section at their air entering side than at their air exiting side so that air passing through them is directed either radially inward or tangentially to the emanating oil from the burner nozzle 5 (see FIG. 1 thereof). Thus, the primary object of the German patent is to control the amont of air that flows through nozzle-ring 4 and fire-ring 3 by means of a ring-bolt 2 having slits 7. This ring-bolt can be moved laterally with respect to the fire-head so as to allow more or less air to pass therethrough and thereby allow more or less air to pass through vanes $4^a$ or $4^b$ of nozzle-ring 4. The hole pattern shown in this reference is unlike the hole pattern of the present oil diffuser and the method of entering air through the vanes is completely unlike that of the present oil diffuser.

Other references which disclose for use with oil burners which create swirling air motions and which do not utilize the conically shaped diffuser with a hole pattern are U.S. Pat. Nos. 3,694,135, Dancy et al; 3,733,169, Lefebvre; and 3,923,251, Flournoy.

The remaining references are directed to fuel burners and attempts to improve their combustion efficiency and turn down ratio. Thus, U.S. Pat. No. 3,360,929, Drewry, discloses a gas turbine combustor utilizing a conical casing within a tube for receiving a flow of compressed air. The casing has an apex with an opening of a size to accommodate a nozzle of a type able to discharge a hollow conical spray within the conical casing. The device also has a guiding cone supported concentrically within the conical casing to form a mixing space therebetween for receiving the hollow spray, the air apertures spaced around the conical casing which cause air to be jetted at high velocity into the mixing space to provide for violent intermixing of air and oil at an early stage before the mixture passes beyond the guiding cone. A review of the figures contained in this reference discloses that the air is not rotationally static but appears to take on a rotary or swirling type motion. This reference also does not disclose or suggest the air hole pattern of the present oil burner diffuser nor the back ring associated as an integral part of this diffuser.

U.S. Pat. No. 3,632,286, Kegan et al, discloses a grid burner suitable for combustion of either a gas or liquid fuel including gutter-type flame holders 10. This reference does not disclose the use of holes in a conical diffuser or the use of a back ring association with such a diffuser.

U.S. Pat. No. 3,529,917, Hindenlang, discloses an air-mixing device for fuel burners having three different embodiments as shown in FIGS. 3–6. All of these embodiments cause the emanating air in the vicinity of the nozzle to converge radially inwardly to a certain extent, at least in the radial vicinity of the oil burner nozzle. The shape of member 60 including the passage hole 64 therein is unlike the air hole pattern of the present invention.

U.S. Pat. Nos. 3,869,243 and 3,881,863, both Creuz, are directed to improvements in gas/oil burners to substantially increase the turn-down ratio or to be used with very high turn-down ratio burners. The turn-down ratio is the ratio between the maximum fuel infeed rate and the minimum fuel infeed rate for which satisfactory operation of the burner can be obtained. In the '243 reference, the improved air damper structure and linkage of the damper to a fuel ratio control opens the damper only at moderate fuel infeed rates. Although a cone 11 is disclosed having holes 21, its hole pattern is substantially different than that of the present oil burner diffuser. Furthermore, the apparent air flow pattern of the '243 reference is unlike the rotationally static air flow obtained by the present invention since the air entering the environs of cone 11 does not do so from a blast tube as does the present invention.

The '863 reference discloses a burner cone 15 having a number of air apertures 16 in a number of circular rows increasing in size from the small upstream end to the large downstream end. Such a hole pattern is unlike that of the present oil burner diffuser. Furthermore, although the last row of apertures at the large end of the disclosed burner cone are used to provide a cylindrically shaped air curtain extending downstream from the burner, similar to the purpose for the outermost row of holes in the present oil burner diffuser, the other aspects of the present invention including the particular air hole pattern within the cone, the angular opening of the cone, and the back ring of the cone are neither disclosed nor suggested by the '863 reference.

Finally, U.S. Pat. No. 4,012,189, Vogt et al, is directed to a hot gas generator for production of hot combustion gases and includes a cylindrical combustion chamber having an inner and outer conduit concentrically disposed thereabout. This reference does not disclose or suggest the air hole pattern of the present oil burner diffuser so as to generate a rotationally static fuel/air mixing zone.

For all of the reasons presented above, it is believed that the present oil burner diffuser is neither disclosed nor suggested by any of these references taken alone or in logical combination with each other.

DISCLOSURE OF INVENTION

The present invention is direced to an oil burner combustion efficiency improving device called a diffuser which is particularly for use on gun-type pressurized oil burners. The disclosed diffuser provides nearly complete combustion of the fuel oil emanating from the pressurized nozzle with a minimum amount of excess air and with negligible carbon buildup on the diffuser and oil burner components. It is well known in the art that air used in excess of that needed for a stoichiometric oxidation of the oil (that is, converting the constituent parts of the hydrocarbon oil from hydrogen to water and from carbon to carbon dioxide) is needlessly heated. The energy used to heat this excess air is wasted since it lowers the temperature of the stoichiometric combustion products and since the excess air decreases the residence time of the other combustion products in the oil burner heat exchanger. Thus the present invention by minimizing the amount of excess air is able to improve the heating efficiency of the burner.

To achieve this increased efficiency, the diffuser is mounted to the end of the burner blast tube associated with gun-type oil burners so that the nozzle of the oil burner is concentrically positioned behind a central opening in the diffuser, depending upon the rating of the nozzle associated with the oil burner. The nozzle is spaced more rearwardly from this central opening for higher flow rate nozzles (such as a 1 to 1.25 gallons per hour nozzles) and less rearwardly for smaller flow rate nozzles (from 0.5 to 0.75 gallons per hour nozzles). The diffuser comprises a cone having this central opening so that the cone is actually in a frustoconical shape. Its central opening has a preferred diameter of 0.9375 inches (24.8 mm). A pattern of hole is positioned around this central opening in a series of rings or circles.

It has been found through testing that the preferred hole patterns for providing nearly complete combustion of the fuel oil with minimum excess air and in a manner which eliminates carbon buildup on the diffuser and oil burner components are patterns of holes arranged in a series of seven rings or circles radially positioned about this central opening. The size, spacial interrelationship, and angular position of these holes through the cone is best understood by examination of the enclosed drawings. The hole patterns are such that a majority of the air emanating from the blast tube exits through the central portion of the one with a smaller portion of the air emanating toward the periphery of the cone. A series of peripheral holes in the cone provide for combustion of any remaining unoxidized fuel and help maintain a cylindrically shaped flame front. The various hole sizes and their angular interrelationship with respect to one another is such that not only is the majority of emanating air forced to pass through the central region of the cone but also that this flow of air prevents the emanating oil from contacting the front surface of the cone until at least approximately half-way from the cone center. It has been experimentally found that due to the temperature generated along the cone surface and especially along its peripheral region, that any oil which may contact the outer peripheral half of cone is oxidized due to the elevated temperature of the cone. This is, in essence, a self-cleaning of any oil deposition and eliminates carbon buildup on the diffuser as well as any of the associated parts of the oil burner.

In addition to the front cone, the diffuser includes a cylindrical member which rearwardly extends from the front, downstream periphery of the cone to approximately the rearward, upstream termination of the cone along its central opening; at which point a back ring extends radially inwardly from the cylindrical member. The back ring prevents the air flowing in the blast tube from concentrating along the periphery of the front cone by diverting this peripheral air flow radially inwardly toward the central opening in the cone as well as toward the holes near the central opening; thereby obtaining maximal air flow through the central opening and associated rows of holes about the central opening. This air deflection has been experimentally found to yield the most satisfactory results in obtaining complete oil combustion with minimum excess air and with virtually negligible carbon buildup on the diffuser and oil burner components.

It is thus readily apparent that the present oil burner diffuser has industrial applications for oil burners of the gun-type variety, and especially those used in furnaces and boilers for home heating purposes.

Therefore, a principal object of the present invention is to provide an oil burner diffuser to improve the combustion efficiency of gun-type oil burners by achieving nearly complete combustion of the fuel oil with minimum excess air and with negligible carbon buildup on the diffuser and associated oil burner components;

Another object of the present invention is to provide an oil burner diffuser of the above description utilizing a front cone having a central opening and a series of holes circularly spaced around the central opening with the hole to non-hole surface area ratio a maximum in the vicinity of the central opening and decreasing radially outwardly along the cone to a minimum approaching the periphery of the cone at which point the ratio increases to a value intermediate the maximum and minimum values, and further including a cylindrical member extending rearwardly from the periphery of the cone and terminating along a plane substantially parallel to that of the central opening of the cone, and a back ring extending radially inwardly from the rearward termination of the cylindrical member, the ring having a width approximately equal to one-fourth the radius of the cone;

Another object of the present invention is to provide an oil burner diffuser of the above description wherein the angular placement of the holes within the cone are at various angles with respect to the cone surface so as to minimize oil deposition on the front surface of the cone and such that the operating temperature of the cone is high enough to self clean any carbon deposition;

Other objects of the present invention will in part be obvious and will in part appear hereinafter.

BRIEF DESCRIPTION OF THE DRAWINGS

For a fuller understanding of the nature and objects of the present invention, reference should be made to the following description of the best mode for carrying out the invention taken in conjunction with the following drawings in which:

FIG. 1 is a top plan view of an oil burner diffuser illustrating its front cone, central opening and hole pattern;

FIG. 2 is a cross-sectional view of the diffuser taken along line 2—2 of FIG. 1 illustrating the hole angle placement for the four rows of holes through which line 2—2 passes;

FIG. 3 is a cross-sectional view of the diffuser taken along line 3—3 of FIG. 1 also illustrating the hole angle placement of the six rows of holes through which line 3—3 passes;

FIG. 6 is a top plan view of another embodiment of the oil burner diffuser illustrating its front cone, central opening and hole pattern;

FIG. 7 is a cross-sectional view of the diffuser taken along line 7—7 of FIG. 6 illustrating the hole angle placement for the rows of holes through which line 7—7 passes;

FIG. 8 is a cross-sectional view of the diffuser taken along line 8—8 of FIG. 6 also illustrating the hole angle placement of the rows of holes through which line 8—8 passes;

BEST MODE FOR CARRYING OUT THE INVENTION

Figure 4:
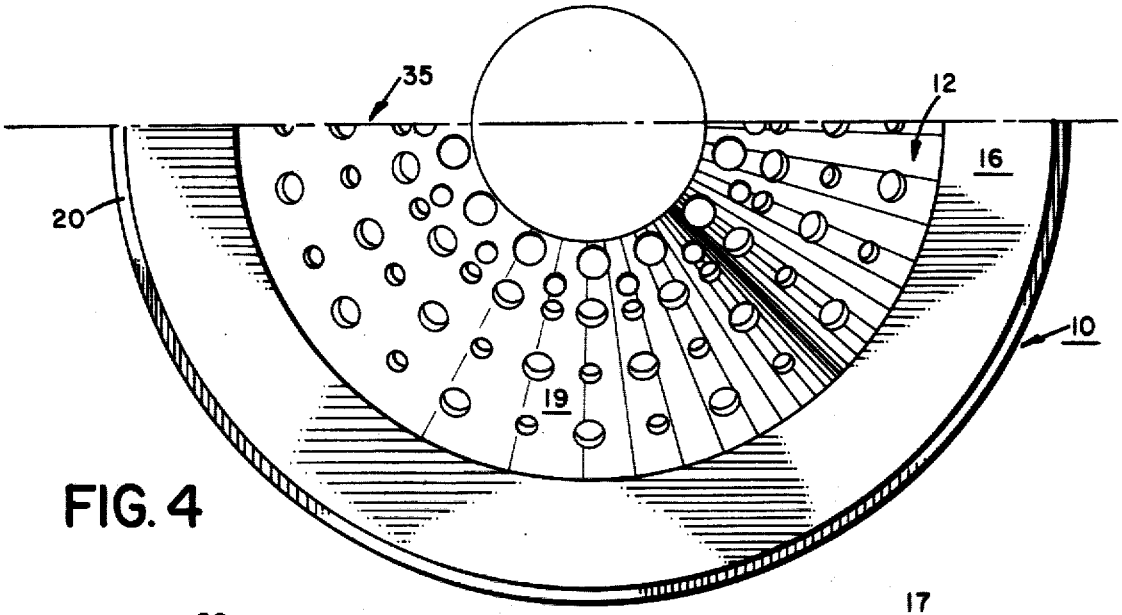
FIG. 4 is a bottom plan view of the diffuser shown in FIG. 1, illustrating the back ring and back surface of the front cone.
Figure 5:
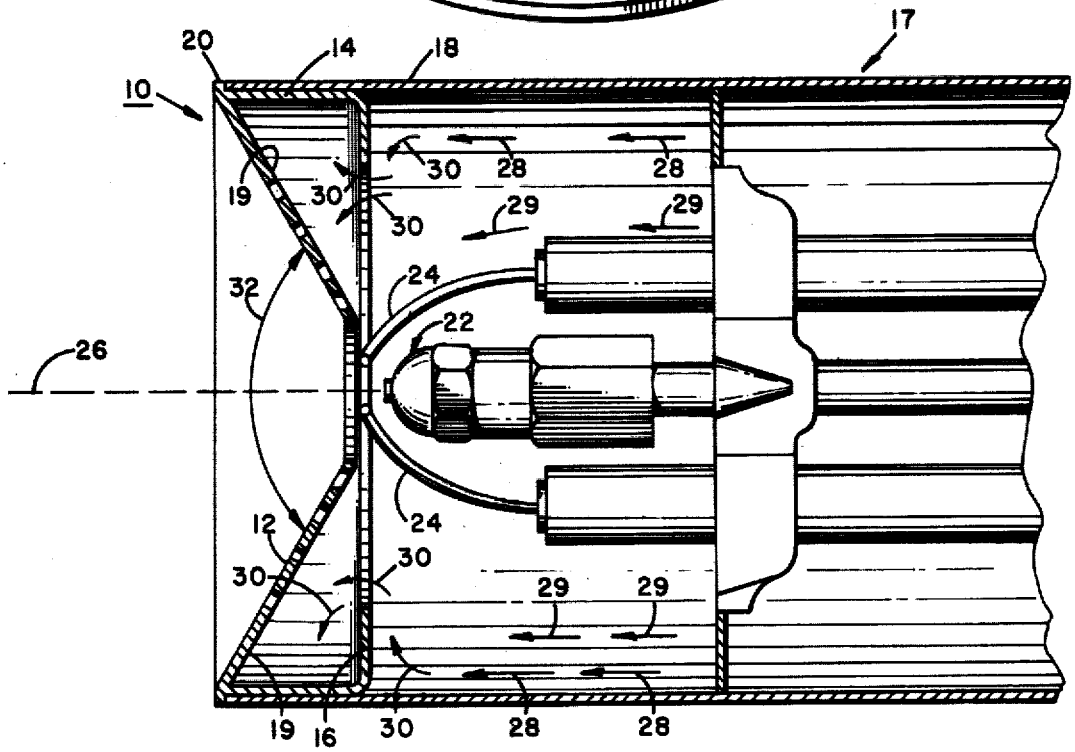
FIG. 5 is a cross-sectional side view of the diffuser shown in FIG. 1, illustrating the mounting of the diffuser on the end of an oil burner blast tube and also showing the interrelationship of the diffuser with respect to the oil burner nozzle and igniting electrodes.

Referring now to FIGS. 1, 2 and 3, it is readily seen that an oil burner diffuser 10 according to the present invention comprises a forwardly positioned cone 12, a rearwardly extending cylindrical member 14, and a radially inwardly extending back ring 16. As best seen in FIG. 5, the diffuser 10 is adapted for placement on the end of a gun-type oil burner 17. Such oil burners are well-known in the heating art and typically include a blast tube 18, an oil spray nozzle 22, oil igniting high voltage electrodes 24, and a source of pressurized air (not shown, but typically a fan) for forcing air down blast tube 18 as shown diagrammatically by peripheral flow arrows 28 and interior flow arrows 29.

The diffuser is attached to the oil burner at the end of the burner blast tube. A rim 20 extends radially outwardly from the outermost or downstream periphery of the cone 12 so as to abut against the terminating end of the oil burner blast tube. The outer periphery of cylindrical member 14 also abuts against the inner periphery of the blast tube 18 so that concentric placement of the diffuser with respect to the blast tube is obtained. This diffuser placement insures that burner nozzle 22 is concentrically positioned behind the diffuser. High voltage electrodes 24 are also positioned behind the diffuser. As will be discussed more fully below, the axial spacing of the nozzle and the electrodes with respect to the diffuser is a function of the nozzle oil flow rate such that the larger the flow rate of the nozzle, the further back the nozzle and electrodes are with respect to the oil diffuser.

It has been experimentally found that in order to promote efficient combustion of the emanating fuel oil from nozzle 22, it is necessary to supply the majority of air emanating from blast tube 18 along, and in the vicinity of, the central axis 26 of the nozzle. It has also been found that to achieve this primary air flow, some of the air passing down the blast tube 18 along its periphery as shown by arrows 28 must be deflected inwardly. This is accomplished by means of the back ring 16 so as to force the peripheral air shown by arrows 28 inwardly toward the cone back surface 19 as shown by arrows 30. The preferred width of this ring is approximately one-fourth the blast tube radius or cone radius. Indeed, the entire geometry of the diffuser constituent parts, including the hole pattern within cone 12, should be substantially as shown in FIGS. 1–5, or as shown in FIGS. 6–8 for an alternative diffuser embodiment, in order to obtain efficient combustion of the emanating fuel oil with minimum excess air and with negligible carbon buildup on the diffuser and oil burner components.

Specifically, for a standard four inch blast tube associated with most home oil burners, the diffuser 10 employs a front cone 12 having an included angle 32 of approximately 120°, a central opening 34 of 0.9375 inches (24.8 mm.), and a hole pattern 35 for circular rows of holes 36, 37, 38, 39, 40, 41 and 42 as shown in FIGS. 1, 2, 3 and 4. Specifically, the number of holes, the spacing of the holes from the central opening 34, the angular placement of the holes with respect to the cone, as well as the number of holes in each row of holes is set forth in Table 1. It should be noted that rows 38, 39 and 40 have two different hole sizes, the smaller holes in rows 38, 39, and 40 designated as 38', 39' and 40' respectively. A visual representation of the angular placement of the holes through the front and rear surfaces 15 and 17 of cone 12 can be seen by examination of FIGS. 2 and 3 which show how the various rows of holes protrude through the cone. A front and rear perspective representation of the hole angular placement can be seen in FIGS. 1 and 4 respectively. As will be best seen in FIGS. 2 and 3, the holes with angular displacements are directed inwardly toward the cone axis.

An alternative embodiment of the present invention is shown in FIGS. 6–8 with details of the hole pattern set forth in Table 1A. The primary difference in this diffuser from that shown in FIGS. 1–5 is in the hole pattern for rows 1 and 2 (rows 36 and 37).

TABLE 1

CHACTERISTICS OF DIFFUSER CONE SHOWN IN FIGS. 1-5

| Row Number (Prime represents smaller holes in row) | Reference Number (Prime represents smaller holes in row) | Number of Holes in Row | Radial Distance from Edge of Cone Central Opening to Center of Hole (inch | mm) | Hole Diameter (inch | mm) | Angular Position of Hole with Respect to Cone Axis (in degrees where 0° is parallel to cone axis) |
|---|---|---|---|---|---|---|---|
| 1 | 36 | 14 | 0.0625 | 1.5875 | 0.109 | 2.7686 | 0° |
| 2 | 37 | 14 | 0.25 | 6.35 | 0.0625 | 1.5875 | 0° |
| 3 | 38 | 14 | 0.375 | 9.525 | 0.128 | 3.2512 | 20° |
| 3' | 38' | 14 | 0.375 | 9.525 | 0.0625 | 1.5875 | 30° |
| 4 | 39 | 14 | 0.594 | 15.0876 | 0.128 | 3.2512 | 30° |
| 4' | 39' | 14 | 0.594 | 15.0876 | 0.0625 | 1.5875 | 30° |
| 5 | 40 | 14 | 0.781 | 19.8374 | 0.128 | 3.2512 | 30° |
| 5' | 40' | 14 | 0.781 | 19.8374 | 0.0625 | 1.5875 | 30° |
| 6 | 41 | 14 | 1.219 | 30.9626 | 0.128 | 3.2512 | 30° |
| 7 | 42 | 32 | 1.5625 | 39.6875 | 0.109 | 2.7686 | 20° |

TABLE 1A

CHARACTERISTICS OF DIFFUSER CONE SHOWN IN FIG. 6*

| Row Number (Prime represents smaller holes in row) | Reference Number (Prime represents smaller holes in row) | Number of Holes in Row | Radial Distance from Edge of Cone Central Opening to Center of Hole (inch | mm) | Hole Diameter (inch | mm) | Angular Position of Hole with Respect to Cone Axis (in degrees where 0° is parallel to cone axis) |
|---|---|---|---|---|---|---|---|
| 1 | 36 | 14 | 0.0625 | 1.5875 | 0.0625 | 1.5275 | 0° |
| 2 | 37 | 14 | 0.188 | 4.7752 | 0.128 | 3.2512 | 0° |
| 2' | 37' | 14 | 0.188 | 4.7752 | 0.0652 | 1.5875 | 0° |
| 3 | 38 | 14 | 0.375 | 9.525 | 0.128 | 3.2512 | 20° |
| 3' | 38' | 14 | 0.375 | 9.525 | 0.0625 | 1.5875 | 30° |
| 4 | 39 | 14 | 0.594 | 15.0876 | 0.128 | 3.2512 | 30° |
| 4' | 39' | 14 | 0.594 | 15.0876 | 0.0625 | 1.5875 | 30° |
| 5 | 40 | 14 | 0.781 | 19.8374 | 0.128 | 3.2512 | 30° |
| 5' | 40' | 14 | 0.781 | 19.8374 | 0.0625 | 1.5875 | 30° |

TABLE 1A-continued

| CHARACTERISTICS OF DIFFUSER CONE SHOWN IN FIG. 6* | | | | | | | |
|---|---|---|---|---|---|---|---|
| Row Number (Prime represents smaller holes in row) | Reference Number (Prime represents smaller holes in row) | Number of Holes in Row | Radial Distance from Edge of Cone Central Opening to Center of Hole (inch | mm) | Hole Diameter (inch | mm) | Angular Position of Hole with Respect to Cone Axis (in degrees where 0° is parallel to cone axis) |
| 6 | 41 | 14 | 1.219 | 30.9626 | 0.128 | 3.2512 | 30° |
| 7 | 42 | 32 | 1.5625 | 39.6875 | 0.109 | 2.7686 | 20° |

*There are also fourteen equally spaced notches along the central opening (See FIG. 6). Also back ring width of 0.3125 inch (7.9375 mm)

In the alternative embodiment, the first row of holes 36 have a smaller diameter and the second row of holes have a larger and smaller series of holes. A series of notches 44 extend radially outward from central opening 34 to minimize carbon buildup in the central cone region. These notches are believed to have compensated for the smaller central air flow resulting from the narrower width of back ring 16, which is 0.3 inch (7.62 mm.).

It has been experimentally found that by having the holes in various rows pass through the front cone at the above described angles, the generation of carbon deposits along the diffuser and oil burner components is prevented. It is believed that this is a result of generating rotationally static non-parallel air currents which prevent low pressure areas along the inner half of cone surface 15. It is believed that such low pressure areas cause oil droplets to contact the front surface of the cone. The present hole pattern prevents oil deposition at least between the first and fifth row of holes; that is, between row of holes 36 and row of holes 40. It has been experimentally found that although oil does contact the front cone surface radially outward from approximately 1.25 inches (31.75 mm.) from the cone center when oil is sprayed from the nozzle without ignition, that the high operating temperature of the cone would self-clean any generated carbon deposits.

For the diffuser shown in FIGS. 6–8 it can be interpolated from Table 2 that the front cone throughout its surface operates at a relatively high temperature sufficient for self-cleaning with the highest temperature occurring toward the periphery of the front cone.

TABLE 2

| Temperature Test Results For 5, 10, and 15 Minute Diffuser operation for Diffuser Shown in FIG. 6–8 | | | |
|---|---|---|---|
| Radius Location (in) | Temperature (F°) at: 5 Min. | 10 Min. | 15 Min. |
| .049 | 744 | 744 | 777 |
| .495 | 960 | 1,014 | 1,014 |
| 1.125 | 1,150 | 1,174 | 1,175 |

In this respect, it is experimentally deduced that any oil which may contact the cone during normal operations is automatically removed due to the residual carbon deposits flaking off under the high temperature conditions.

It is also believed that under normal operating conditions (where the oil is ignited) oil droplets rarely contact any part of the cone surface. This is probably due to the axially propagating flame front which tends to draw away from one cone surface oil droplets from the burner nozzle. Therefore, although the exact reason for no carbon buildup may be either self-cleaning or no oil droplet surface deposition, or both, the end result is a diffuser that operates cleanly.

Figure 9:
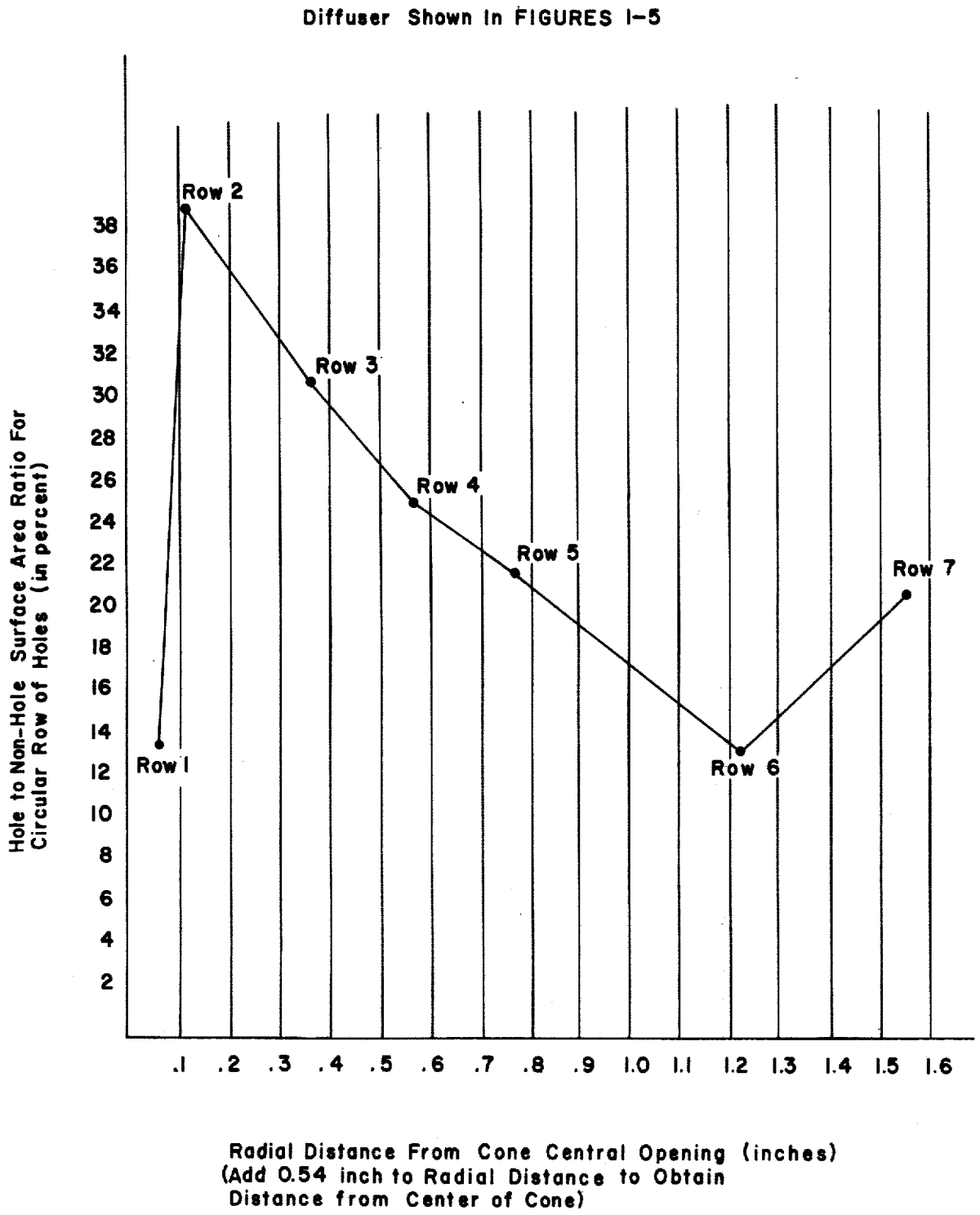
FIG. 9 is a graph illustrating the relationship between the hole to non-hole surface area ratio of the diffuser cone shown in FIG. 1 for each circular row of holes as a function of radial distance from the cone central opening.
Figure 10:
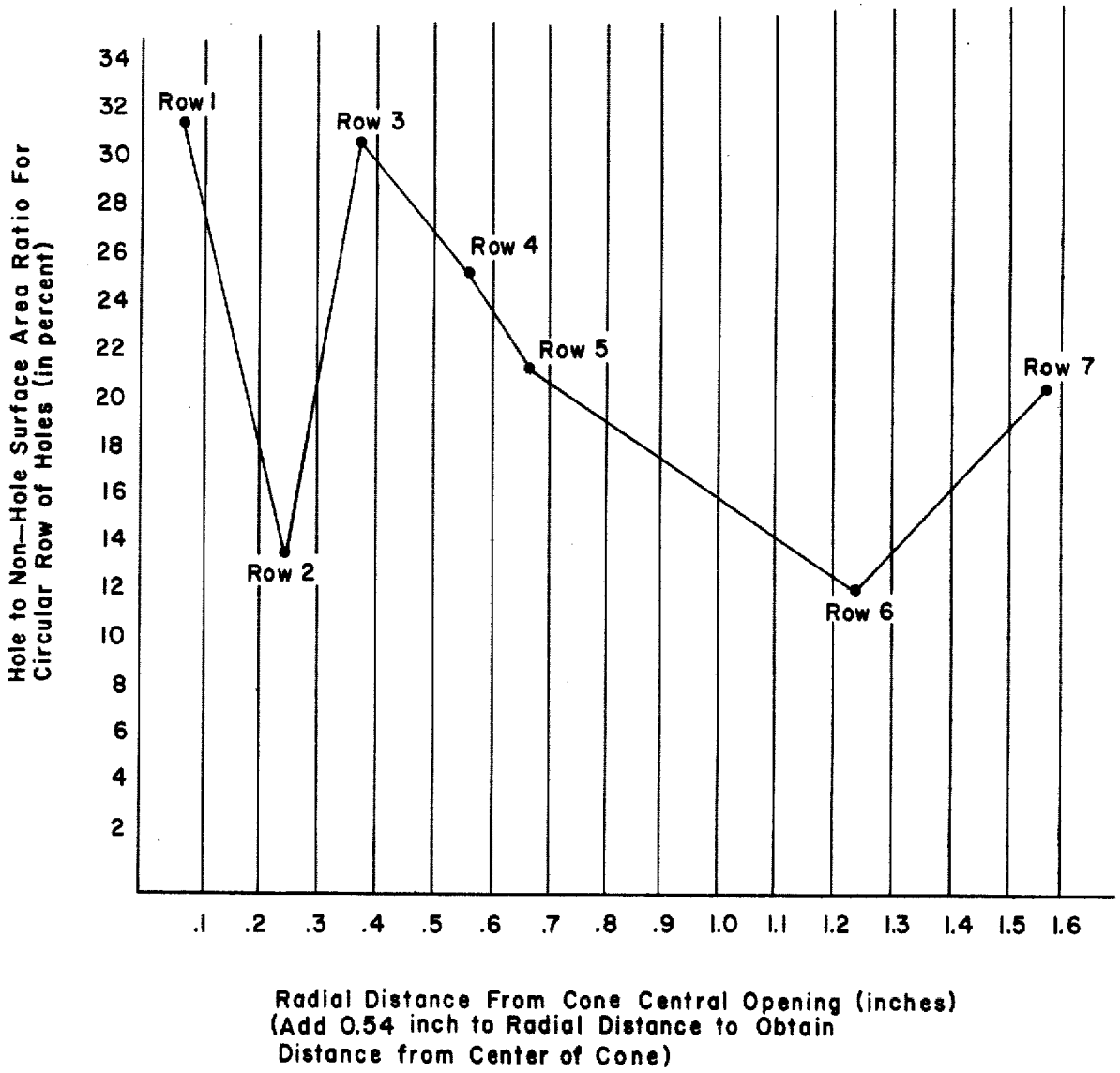
FIG. 10 is a graph illustrating the relationship between the hole to non-hole surface area ratio of the diffuser cone shown in FIG. 6 for each circular row of holes as a function of radial distance from the cone central opening.

It has also been experimentally found that not only is the hole placement but the hole to non-hole surface area ratio as a function of radial distance on the cone important in maintaining efficient operation with negligible carbon buildup. As best seen in FIGS. 9 and 10, the percentage of hole surface area to solid surface area for the cones shown in FIGS. 1 and 6 respectively as a function of radial distance from the cone central opening illustrates that the hole to non-hole surface area ratio decreases from a maximum at row 1 or 2, near the upstream central opening end, to a minimum as the radial distance approaches the periphery of the cone (row 6) and then increases, at the extreme downstream end (row 7) to a value intermediate the maximum and minimum values. Indeed, the sixth and seventh rows of holes 41 and 42 are positioned so that any oil emanating from the spray nozzle 22 which remains unoxidized as it approaches this radial distance is then supplied with sufficient amounts of air (and thus oxygen) to complete combustion of this residual oil. The last row of holes 42 also tends to maintain the flame front in a cylindrical pattern rather than allow the emanating oil—which is typically of a hollow or solid cone spray pattern—from continuing in its radially outward direction.

Detailed test results for oil burner diffusers corresponding to the two disclosed are set forth in Table 3. The heating unit used in this test was a Williamson Model 1167-12 Warm Air Furnace. The efficiency rating given is based upon the relationship between percentage of oxygen in the flue gases by volume and percent efficiency for various flue gas temperatures as set forth in a publication entitled "Balancing Boilers Against Plant Loads" by R. D. Smith and R. B. Scollon appearing in the Mar. 29, 1976 *Chemical Engineering* magazine. A graph illustrating this relationship is set forth in FIG. 11.

These efficiency ratings are related to the heating unit effieiency; that is, the percentage of energy usable for heating the building as compared to the energy into the heating unit based on the chemical energy in the oil. Thus not only is complete combustion of the oil desirable, but also such combustion with minimum excess air which represents part of the stack energy losses. These stack losses are a function of the volume of combusion product gases and their temperature. The higher the stack gas temperatures, the less efficient the heat exchanger is for the furnace or boiler.

The improved efficiency for the warm air furnace used for Table 3 when the diffusers according to the present invention are used as compared to when they are not is primarily due to less stack losses; that is, less excess air used to oxidize the fuel oil.

A detailed analysis of heating unit efficiencies is given in Table 3A and is a result of the work given in the above article by Smith and Scollon.

It should be noted the heating unit improved efficiency when using the diffuser is related to the improved carbon dioxide percentage in the combustion gases as explained earlier (see Table in Background section). That is the higher the carbon dioxide concentration, the lower the oxygen concentration in the combustion gases, and therefore the higher the heating unit efficiency; all other things being equal.

Since the diffusers according to the present invention are able to yield carbon dioxide concentration higher than 14% (representing less than 7% excess air) the improved heating unit efficiencies given for Table 3 approach the theoretical maximums obtainable for a given fuel nozzle when used in that particular heating unit.

It has also been experimentally found that for small flow rate oil nozzles, such as a 0.5 gallon per hour nozzle, the nozzle must be positioned relatively close to central opening 34 and that for larger flow rate nozzles up to approximately 1.25 gallon per hour nozzles, the nozzle must be proportionately rearwardly moved axially away from central opening 34. At first it was believed that this was due to the point where the oil nozzle spray, which is typically of a hollow cone shape, changed from a "solid sheet" to a mist of oil droplets. However, it was experimentally found as set forth in Table 4 that for various manufacturer's oil nozzles the length of "solid sheet" did not dictate this rearward placement of the nozzle.

TABLE 3

| Heating Unit | Nozzle flow rate spray included angle (gallons per hour/ degrees) | Stack Temp. (°F.) | Oxygen Conc. (%) | Smoke Density Number | Efficiency % | Approximate Improvement Over Standard Unit Without Diffuser % | Remarks |
|---|---|---|---|---|---|---|---|
| Williamson Co. Cincinnati, Ohio, Model 1167-12 warm air home furnace | 1.0/80* | 568 | 1.5 | 1 | 82% | 1 | no carbon buildup |
| | .85/80* | 483 | 1.7 | 2 | 83% | 2 | no carbon buildup |
| | .50/80* | 360 | 4.6 | 2 | 85% | 5 | no carbon buildup |
| | .85/80** | 469 | 1.5 | 1 | 84% | 4 | no carbon buildup |

*diffuser shown in FIGS. 6-8 having a cone thickness = 0.03 inch (0.76 mm.), fabricated from stainless steel
**diffuser shown in FIGS. 1-5 having a cone thickness = 0.0625 inch (1.58 mm.), fabricated from Inconel ® high percentage nickel alloy.

TABLE 3A

Basis For Determining Heating Unit Efficiencies

Heating Unit Efficiency

In order to determine the effectiveness of a diffuser in altering heating unit efficiency, it is only necessary to determine the change in efficiency resulting from the use of the diffuser.

The method used to measure efficiency is based on the first law of thermodynamics which states, in effect, that the total energy leaving a furnace or boiler is equal to the energy entering. This principle can be stated mathematically as:

$$E_{in} = E_{used} + E_{stack} + E_{rad} \quad (1)$$

Figure 12:
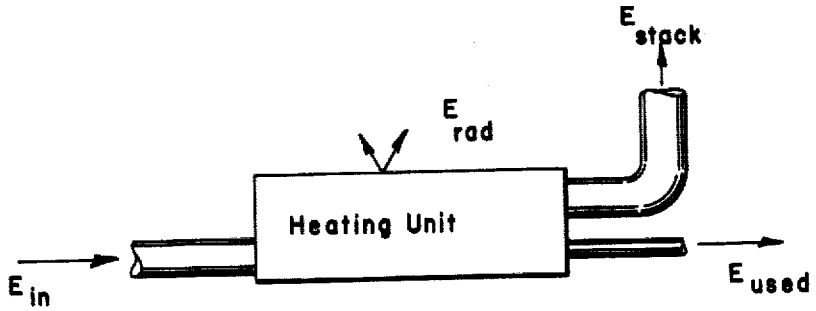
FIG. 12 is a diagrammatic representation of the energy equation representing the conservation of energy when a fuel oil is oxidized in a heating unit.

(See FIG. 12)

Efficiency is defined as:

$$n_b = \frac{E_{used}}{E_{in}} \quad (2)$$

TABLE 3A-continued

Basis For Determining Heating Unit Efficiencies

Heating Unit Efficiency or, alternately, can be defined as:

$$n_b = 1 - \frac{(E_{stack} + E_{rad})}{E_{in}} \quad (3)$$

Equation 3 is derived from equations 1 and 2. It is clear from equations 2 and 3 that unit efficiency can be determined either by measuring the energy used or the energy lost; it is not necessary to measure both if the energy into the heating unit can be determined.

The radiation loss $E_{rad}$ is small compared to $E_{stack}$ and is not likely to be affected by the use of a diffuser. As a result, equation 3 can be simplified to:

$$n_b = 1 - \frac{E_{stack}}{E_{in}} \quad (4)$$

Equation 4 can be rewritten in terms of the properties of the combustion products, as follows:

$$n_b = 1 - \frac{\dot{m}_p c_p \Delta T + \dot{m}_p \Delta H_{CO} x_{CO} + \dot{m}_p \Delta H_C x_C}{\dot{m}_f \Delta H_f} = 1 - \left(\frac{c_p \Delta T + \Delta H_{CO} x_{CO} + \Delta H_C x_C}{\Delta H_f}\right)\left(\frac{\dot{m}_p}{\dot{m}_f}\right) \quad (5)$$

where $\dot{m}_p$ = mass flow rate of combustion products
$c_p$ = specific heat of combustion products
$\Delta T$ = temperature of combustin products above ambient
$\Delta H_{CO}$ = heat of combustion of CO
$x_{CO}$ = mass fraction of CO in products
$\Delta H_C$ = heat of combustion of carbon (soot)
$x_C$ = mass fraction of carbon in products
$\dot{m}_f$ = mass flow rate of fuel
$\Delta H_f$ = heat of combustion of fuel Equation 5 states that the energy loss from the unit consists of three elements: (1) the sensible heat of the combustion products, (2) the chemical energy of unburned CO, and (3) the chemical energy of unburned carbon (soot). The energy loss also is affected by the excess air rate which is contained in the term $\dot{m}_p/\dot{m}_f$. This term can be written as:

$$\frac{\dot{m}_p}{\dot{m}_f} = \frac{\dot{m}_f + \dot{m}_{a,s} + \dot{m}_{a,e}}{\dot{m}_f} \quad (6)$$

where $\dot{m}_{a,s}$ = mass flow rate of air required to burn fuel
$\dot{m}_{a,e}$ = mass flow rate of excess air Equation 6 can be written in terms of the oxygen content of the combustion products:

$$\frac{\dot{m}_p}{\dot{m}_f} = \left(\frac{\dot{m}_f + \dot{m}_{a,s}}{\dot{m}_f}\right)\left(\frac{0.21}{0.21 - x_{O2}}\right) \quad (7)$$

where $x_{O2}$ = mole fraction of $O_2$ in products.

TABLE 3A-continued

Basis For Determining Heating Unit Efficiencies

Heating Unit Efficiency

Combining equations 5 and 7, we obtain a final equation indicating the measurements necessary to determine unit efficiency by measuring energy lost:

$$\eta_b = 1 - \left(\frac{c_p\Delta T + \Delta H_{CO}x_{CO} + \Delta H_C x_C}{\Delta H_f}\right)\left(\frac{\dot{m}_{a,s}}{\dot{m}_f} + 1\right)\left(\frac{0.21}{0.21 - x_{O_2}}\right) \quad (8)$$

The only unknown quantities in this equation are:

1. Product temperature above ambient ($\Delta T$)
2. CO mass fraction ($x_{CO}$)
3. Carbon mass fraction ($x_C$)
4. $O_2$ mole fraction ($x_{O_2}$)
5. Fuel heat of combustion ($\Delta H_f$)

For the diffuser evaluation, certain assumptions and constraints were used, namely 1. losses associated with CO and Carbon formation are negligible;
2. fuel heat of combustion, $\Delta H_c$ is constant;
3. the expressions are based on dry flue gas losses. Losses due to water vapor formed during combustion were included in our assessments.

Figure 11:
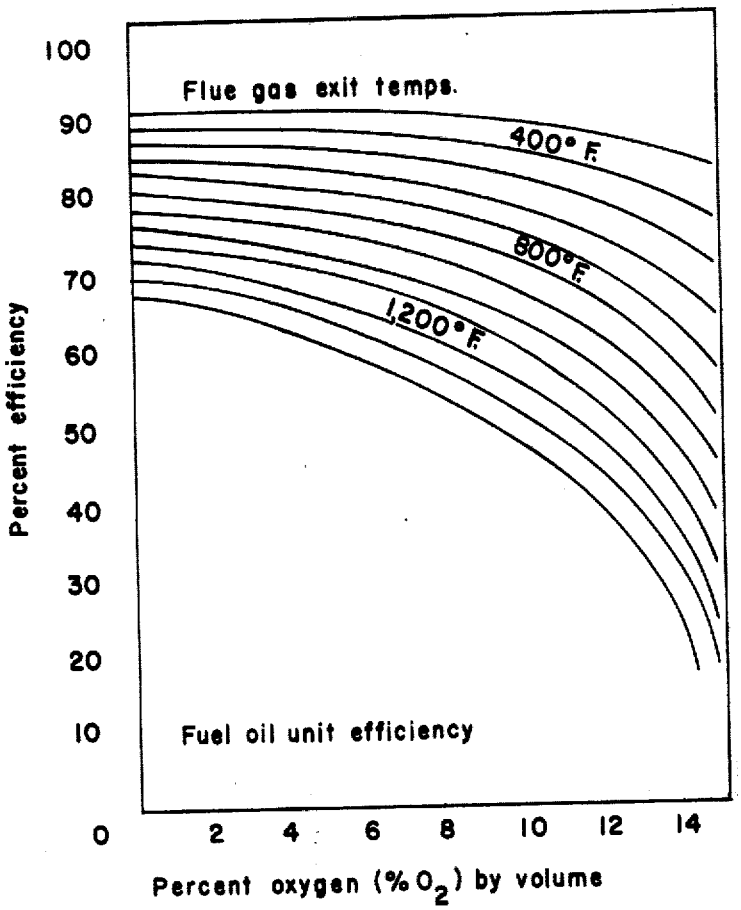
FIG. 11 is a graph illustrating the relationship between percentage of exhaust oxygen by volume and percent efficiency for fuel oil combustion heat transfer at various flue gas temperatures.

FIG. 11 illustrates a relationship between percent oxygen and unit efficiency approximated by equation (8).

TABLE 4

Hollow Cone Nozzle Spray Test Results

| Nozzle Manufacture | Size (gallons per hour/ included angle in degree) | Approximate spray angle (degree) | Approximate length of "solid sheet" (in) |
|---|---|---|---|
| Monarch Mfg. | .50/80 | 105 | .32 |
| Monarch Mfg. | .85/80 | 105 | .28 |
| Monarch Mfg. | 1.0/80 | 90 | .27 |
| Hago Products | .50/80 | 80 | .26 |
| Hago Products | .85/80 | 95 | .23 |
| Hago Products | 1.0/80 | 90 | .26 |
| Delavan Corp. | .65/80 | 70 | .20 |
| Delavan Corp. | .85/80 | 95 | .27 |
| Delavan Corp. | 1.0/80 | 95 | .24 |
| SH Mfg. | .50/80 | 100 | .24 |

It will be noted that the spray angle of the various nozzles indicate that for smaller gallon per hour nozzles, the spray angle, though all nominally at a quoted included angle of 80°, actually exhibit a wider angle approaching the 120° angle of the cone, therefore perhaps necessitating the placement of the nozzle closer to the central opening for these smaller gallon per hour nozzles. It is also believed that placement of the nozzle closer to the central opening for these smaller flow nozzles is a function of further restricting air flow within the blast tube and out through the central opening and the holes in the cone. In this respect, it has been found necessary to close the air shutter normally associated with gun-type oil burners so as to minimize the intake of air to the blast tube. Thus, it is apparent that the present invention is able to provide nearly complete combustion of the fuel oil with minimal excess air to such an extent that present day oil burners must have their air shutters completely closed with the only entering air to the blast tube coming from normal air leakage.

It has been experimentally found that the optimal width of the back ring 16 is approximately 0.44 inches (11.77 mm.), or about one-fourth the radius of cone 12. A wider back ring tends to divert too much peripheral blast tube air flow towards the central opening and thereby providing insufficient air flow through the sixth and seventh rows of holes 41 and 42. Conversely, a narrower back ring provides too much air flow through the outer peripheral holes and insufficient air through the central rows of holes where the majority of the emanating oil is oxidized.

The optimal back ring width is associated with a cylindrical member 14 width of about 1 inch (25.4 mm). This latter width is approximately equal to the axial length of cone 12 and therefore terminates in a plane parallel with and substantially coextensive with the plane defined by central opening 14.

Finally, for fabricating the diffuser, high temperature, high percentage nickel alloy metals having a thickness of about 0.0625 inches (1.58 mm.) were found to meet the stringent requirements for such diffusers, including high temperature corrosion resistance, thermal cycling resistance, resistance to chemical attack especially with respect to sulphur, carbon and oxygen compounds, workability in fabrication, dimensioned stability at high temperature, and reasonable cost. Inconel® 601 and Incoloy® 800 manufactured by Huntington Alloys, Inc. of Huntington, W.Va. 25720 have been found most suitable for diffuser fabrication. The specific properties of these alloys are set forth in Table 5. The diffuser shown in FIGS. 6–8 was fabricated from 0.03 inch (0.76 mm.) stainless steel. It exhibited slightly less improved efficiency for a 0.85 gallon per hour fuel nozzle (see Table 3) than the diffuser shown in FIGS. 1–5 fabricated from 0.0625 inch (1.58 mm.) Inconel® high percentage nickel alloy. This may be due to the smaller angular air flow paths emanating from the thinner cone as a result of shorter holes in the thinner cone. It may also be due to the narrower back ring of the diffuser shown in FIGS. 6–8.

Thus what has been described as an oil burner diffuser comprising a cone, cylindrical member, and back ring and having a central hole and a pattern of holes in the cone which provide for nearly complete combustion of the emanating fuel oil from a gun-type oil burner with minimal excess air and with negligible carbon buildup on the diffuser and associated oil burner components.

It will thus be seen that the objects set forth above, and those made apparent from the preceding description, are efficiently attained, and since certain changes may be made in the above construction without departing from the scope of the invention or from the method of carrying out the invention, it is intended that all matter contained in the above description and shown in the accompanying drawings shall be interpreted as illustrative and not in a limiting sense.

TABLE 5

(Properties of Inconel® 601 and Incoloy® 800)

| | Inconel® 601 | Incoloy® 800 |
|---|---|---|
| General Comments | Excellent resistance to high temperature, oxidizing, carburizing and sulphur containing atmospheres | Excellent resistance to high temperature oxidation and carbonization and sulphur attack. Resists internal oxidation and scaling. |
| Chemical Composition (%) | | |
| Nickel | 60.5 | 32.5 |
| Iron | 14.1 | 46.0 |
| Chromium | 23.0 | 21.0 |
| Other | Al 1.35 | |
| Thermal Conductivity (Btu in/ft$^2$ hr °F.) | | |

TABLE 5-continued (Properties of Inconel ® 601 and Incoloy ® 800)

| | Inconel ® 601 | Incoloy ® 800 |
|---|---|---|
| 70° | 78 | 80 |
| 150° | 171 | 174 |
| Mechanical Properties | | |
| Tensile strength | 85-120 Kpsi | 80-120 Kpsi |
| Yield strength | 35-100 Kpsi | 35-90 Kpsi |
| Hardness | 115-215 Brinnel | 140-217 Brinnel |
| Both alloys exhibit workability similar to Type 304 stainless steel. | | |

It is also understood that the following claims are intended to cover all the generic and specific features of the invention described, and all statements of the scope of the invention which as a matter of language might be said to fall therebetween.

Having described the invention, what is claimed is:

1. An oil burner diffuser for increasing the combustion efficiency in a gun-type oil burner having a fuel injector nozzle for discharging a conically-shaped fuel spray pattern centrally about a central blast tube and means for supplying pressurized air to the blast tube, wherein the improved combustion efficiency is obtained with a minimal amount of excess air and with negligible carbon buildup on the diffuser and associated oil burner components, wherein the diffuser comprises:

(A) a cone having a central opening at its upstream end axially positionable with the oil burner nozzle, and holes positioned in radially extending circles about this central opening, with the hole to non-hole surface area ratio for these circles decreasing from a maximum near the cone central opening to a minimum near the downstream end of the cone and then increasing, at the extreme downstream end thereof, to a value intermediate the maximum and minimum values;

(B) a rearwardly extending cylindrical member attached to the outer, downstream periphery of the cone; and (C) a back ring extending radially inwardly from the rearward termination of the cylindrical member.

2. An oil burner diffuser as defined in claim 1 wherein the downstream termination of the cylindrical member defines a plane approximately coextensive with the plane defined by the cone central opening.

3. An oil burner diffuser as defined in claim 1 or 2 wherein the back ring has a width approximately equal to ¼ the width of the cone radius so as to cause the peripheral airflow in the blast tube to be deflected radially inwardly so that a majority of the airflow passes through the central opening and circular rows of holes within the inner radial half of the cone.

4. An oil burner diffuser defined in claim 3 wherein the cone central opening has a radius approximately equal to ¼ the cone radius.

5. An oil burner diffuser defined in claim 4 wherein the holes are positioned in seven radially extending circles about the cone's central opening.

6. An oil burner diffuser as defined in claim 5 wherein the holes positioned in the first five radially extending circles are positioned in the inner radial half of the cone and wherein the holes positioned in the sixth and seventh radially extending circles are positioned in the outer radial half of the cone.

7. An oil burner diffuser as defined in claim 6 wherein each hole in the first circle of holes has the same size, each hole in the second circle of holes has the same size, each of approximately half the holes of the third circle of holes has the same size while each of the remainder of holes in the third circle of holes has another size, each of approximately half the holes of the fourth circle of holes has the same size while each of the remainder of holes in the fourth circle of holes has another size, each of approximately half the holes of the fifth circle of holes has the same size while each of the remainder of holes in the fifth circle of holes has another size, each hole in the sixth circle of holes has the same size, and each hole in the seventh circle of holes has the same size, and wherein the seventh circle of holes comprises more than twice the number of holes than the number of holes in any other circle of holes having the same size.

8. An oil burner diffuser as defined in claim 1 wherein the oil burner diffuser is fabricated from a high percentage nickel alloy and has a cone thickness of between 0.03 inch (0.76 mm.) and 0.0625 inch (1.58 mm.).

9. An oil burner diffuser as defined in claim 7, wherein the oil burner diffuser is fabricated from a high percentage nickel alloy and has a cone thickness of between 0.03 inch (0.76 mm.) and 0.0625 inch (1.58 mm.).

10. An oil burner diffuser as defined in claim 7 wherein the holes in the innermost circle of holes each have an angular displacement of approximately 0° with respect to the axis of the cone passing through the cone's central opening, where 0° is parallel to the axis, wherein the holes in the second circle of holes each have an angular displacement of approximately 0° with respect to the cone's axis, wherein the holes in the third circle of holes each have an angular displacement of between 20° and 30° with respect to the cone's axis, wherein the holes in the fourth circle of holes each have an angular displacement of approximately 30° with respect to the cone's axis, wherein the holes in the fifth circle of holes each have an angular displacement of approximately 30° with respect to the cone's axis, wherein the sixth circle of holes each have an angular displacement of approximately 30° with respect to the cone's axis, and wherein the holes in the seventh circle of holes each have an angular displacement of approximately 20° with respect to the cone's axis.

11. An oil burner diffuser for increasing the combustion efficiency in a gun-type oil burner having a fuel injector nozzle for discharging a conically-shaped fuel spray pattern centrally about a central blast tube and means for supplying pressurized air to the blast tube, wherein the improved combustion efficiency is obtained with a minimal amount of excess air and with negligible carbon buildup on the diffuser and associated oil burner components, wherein the diffuser comprises:

(A) a cone having a central opening at its upstream end axially positionable with the oil burner nozzle, and holes positioned in radially extending circles about this central opening, with the hole to non-hole surface area ratio for these circles decreasing from a maximum near the cone central opening to a minimum near the downstream end of the cone and then increasing, at the extreme downstream end thereof, to a value intermediate the maximum and minimum values;

(B) a rearwardly extending cylindrical member attached to the outer, downstream periphery of the cone, terminating in a plane approximately equal to the plane of the cone central opening; and (C) a back ring extending radially inwardly from the rearward termination of the cylindrical member, and having a width approximately equal to one-fourth the cone radius.

12. An oil burner diffuser as defined in claim 1 further comprising:

(D) a peripheral rim about the downstream termination of the cone dimensioned for abutting against the termination of the oil burner blast tube for facilitating placement of the diffuser within the outer end of the blast tube.

13. An oil burner diffuser as defined in claim 1 or 2 wherein the central opening is circular having a radius approximately equal to one-fourth the cone radius.

14. An oil burner diffuser as defined in claim 13 wherein the cone included angle is approximately 120°.

15. An oil burner diffuser as defined in claim 1, wherein each hole has either a circular or elliptical cross-sectional periphery.

16. An oil burner diffuser as defined in claim 7, wherein each hole has either a circular or elliptical cross-sectional periphery.

17. An oil burner diffuser as defined in claims 1, 2, 8, 11 or 12 wherein the cone central opening further has a plurality of radially inwardly projecting notches.

18. An oil burner diffuser as defined in claim 17, wherein the holes in each radially extending circle are uniformly spaced from each other, and wherein the notches are simiilarly uniformly spaced from each other.

19. An oil burner diffuser as defined in claim 3, wherein the cone central opening further has a plurality of radially inwardly projecting notches.

20. An oil burner diffuser as defined in claim 19, wherein the holes in each radially extending circle are uniformly spaced from each other, and wherein the notches are similarly uniformly spaced from each other.

21. An oil burner diffuser as defined in claim 13, wherein the cone central opening further has a plurality of radially inwardly projecting notches.

22. An oil burner diffuser as defined in claim 21, wherein the holes in each radially extending circle are uniformly spaced from each other, and wherein the notches are similarly uniformly spaced from each other.

23. An oil burner diffuser as defined in claims 1, 2, 11 or 12 wherein the holes in each radially extending circle are uniformly spaced from each other.

24. An oil burner diffuser as defined in claim 7, wherein the holes in each radially extending circle are uniformly spaced from each other.

* * * * *